US009267234B2

(12) United States Patent
Huhtanen et al.

(10) Patent No.: US 9,267,234 B2
(45) Date of Patent: Feb. 23, 2016

(54) BLADE ELEMENT AND REFINER

(71) Applicants: Juha-Pekka Huhtanen, Tampere (FI); Vesa Harju, Tampere (FI); Markku Partanen, Valkeakoski (FI); Olli Tuovinen, Tampere (FI); Petteri Vuorio, Valkeakoski (FI)

(72) Inventors: Juha-Pekka Huhtanen, Tampere (FI); Vesa Harju, Tampere (FI); Markku Partanen, Valkeakoski (FI); Olli Tuovinen, Tampere (FI); Petteri Vuorio, Valkeakoski (FI)

(73) Assignee: Valmet Technologies, Inc., Espoo (FI)

( * ) Notice: Subject to any disclaimer, the term of this patent is extended or adjusted under 35 U.S.C. 154(b) by 73 days.

(21) Appl. No.: 14/140,363

(22) Filed: Dec. 24, 2013

(65) Prior Publication Data

US 2014/0217218 A1 Aug. 7, 2014

(30) Foreign Application Priority Data

Dec. 27, 2012 (FI) ..... 20126380

(51) Int. Cl.

| | |
|---|---|
| ***B02C 7/00*** | (2006.01) |
| ***D21D 1/30*** | (2006.01) |
| ***B02C 7/12*** | (2006.01) |
| ***D21D 1/22*** | (2006.01) |

(52) U.S. Cl.

CPC *D21D 1/306* (2013.01); *B02C 7/12* (2013.01); *D21D 1/22* (2013.01); *D21D 1/303* (2013.01)

(58) Field of Classification Search

CPC ..... D21D 1/30; D21D 1/303; D21D 1/306; D21B 1/063; D21B 1/14

USPC ..... 241/261.2, 261.3, 296, 298

See application file for complete search history.

(56) References Cited

U.S. PATENT DOCUMENTS

| | | | | |
|---|---|---|---|---|
| 3,117,603 | A * | 1/1964 | Van Keuren et al. | 241/298 |
| 3,918,217 | A * | 11/1975 | Oliver | 51/295 |
| 4,372,495 | A * | 2/1983 | Marton et al. | 241/28 |
| 4,384,564 | A * | 5/1983 | Smith et al. | 125/18 |
| 4,423,845 | A | 1/1984 | Frazier et al. | |
| 5,492,548 | A * | 2/1996 | Wasikowski | 51/293 |
| 5,704,559 | A | 1/1998 | Fröberg et al. | |
| 5,836,525 | A * | 11/1998 | Garnier et al. | 241/28 |
| 5,868,330 | A * | 2/1999 | Dodd et al. | 241/296 |
| 5,975,438 | A * | 11/1999 | Garasimowicz | 241/15 |
| 7,419,112 | B2 * | 9/2008 | Sjostrom et al. | 241/298 |
| 7,445,174 | B2 | 11/2008 | Virving | |

FOREIGN PATENT DOCUMENTS

AT 393520 B 11/1991

OTHER PUBLICATIONS

Somboon, Phichit, "On the Application of Grits to Thermomechanical Pulp Refining", TKK Reports in Forest Products Technology, Series A7, Espoo, dated Feb. 27, 2009.

Somboon, P. & Pynnönen, T. "Performance of Abrasive Segments in Mechanical Pulp Refining". A review.

* cited by examiner

*Primary Examiner* — Faye Francis

(74) *Attorney, Agent, or Firm* — Stiennon & Stiennon

(57) ABSTRACT

A refiner (1, 2, 3) for refining fibrous material. And a blade element (18) for a refiner (1, 2, 3) intended for refining fibrous material. The blade element (18) having a refining surface (18'), which has blade bars (21, 23) and blade grooves (22, 24) between them. The top surface of at least one blade bar (21, 23) is provided with refining grits (25). The blade element (18) has portions (29, 30) forming a protruding part extending away above the refining surface (26*a*, 26*b*) and above the blade bars (21, 23) or the refining grits (25) on the refining surface.

19 Claims, 7 Drawing Sheets

A-A

B-B

BLADE ELEMENT AND REFINER

CROSS REFERENCES TO RELATED APPLICATIONS

This application claims priority on Finnish Application No. FI 20126380, filed Dec. 27, 2012, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a blade element for a refiner for refining fibrous material, the blade element comprising a refining surface, the refining surface in turn comprising blade bars and blade grooves between them.

The invention further relates to a refiner for refining fibrous material, the refiner comprising at least two refining elements positioned oppositely at a distance from one another and moving in relation to one another, the opposite surfaces of the refining elements being provided with a refining surface for refining fibrous material and that the refining surface of at least one refining element comprises blade bars and blade grooves between them.

Refiners intended for refining fibrous, lignocellulose-containing material, such as wood material, are employed, for instance, for producing pulp to be used in paper or board making. During the refining the fibers in the fibrous material are modified with the intention of acting on the properties of the bonds between fibers created in the fiber web to be formed of the pulp. The fibrous material is refined in refiners into which the fibrous material to be refined is supplied as a pulp mixture of fibrous material and water.

Refiners meant for processing fibrous material comprise two or more substantially oppositely positioned refining elements. A refiner typically comprises one fixed refining element, i.e. a stator, and a refining element rotatable in relation to the fixed refining element, i.e. a rotor. The fixed refining element is supported to the refiner frame and the rotatable refining element is coupled to a rotation motor by a shaft. The fixed refining element comprises a body and one or more blade elements attached thereto, the blade surfaces, or refining surfaces, of the blade elements together forming the refining surface of the fixed refining element. Alternatively, the fixed refining element is formed of one or more blade elements fastened directly to the refiner frame. The rotatable refining element comprises a body and one or more blade elements attached thereto, the blade surfaces, or refining surfaces, of the blade elements together forming the refining surface of the rotatable refining element.

The fixed refining element and the rotatable refining element are placed oppositely to one another and at a distance from one another, the distance forming a blade gap of the refiner. The oppositely aligned refining surfaces and the blade gap define a refining space in which the refining takes place. The refining is caused by pressing of the refining surfaces against one another and the motion between them, as a result of frictional forces between the refining surfaces and the material to be refined and, on the other hand, as a result of internal frictional forces created in the material to be refined. The size of the blade gap may vary at different points of the refining space. The fibrous material to be refined is supplied into the refining space through a supply opening, which is connected by a supply channel to a process step preceding the refining. The refined fibrous material is removed from the refining space through a discharge opening, which is connected by a discharge channel to a process step following the refining.

In other words, the refining surface of the refining element is formed of the refining surface of one blade element or the refining surfaces of a plural number of blade elements placed next to one another. The refining surface of the blade element, and hence also the refining surface of the actual refining element, comprises blade bars and blade grooves between them. The blade bars on the oppositely placed refining surfaces participate in the actual refining, whereas the blade grooves between the blade bars move the material to be refined and the material already refined onward on the refining surfaces of the refining elements.

SUMMARY OF THE INVENTION

The object of this invention is to provide a novel blade element for refining fibrous material.

The blade element of the invention is characterized in that the top surface of at least one blade bar is provided with refining grits and that the blade element comprises a protruding part extending away from the refining surface and dimensioned to extend above the blade bars on the refining surface and the refining grits placed to the top surface of the blade bars.

The refiner of the invention is characterized in that the refining surface of at least one refining element is provided with refining grits and in that at least one refining element of the refiner comprises at least one protruding part extending toward an opposite refining element and dimensioned to extend above the blade bars and/or refining grits on the refining surface of the refining element, the protruding parts being arranged to prevent the blade bars and/or refining grits on oppositely positioned refining elements from touching one another.

The blade element for a refiner meant for refining fibrous material comprises a refining surface, which in turn comprises blade bars and blade grooves between them. The blade element further comprises refining grits provided on the top surface of at least one blade bar and a protruding part protruding from the refining surface and being dimensioned to extend above the blade bars on the refining surface and the refining grits provided on the top surface of the blade bars.

The refining grits provided on the top surface of the blade bars increase the cutting length of the refining surface, i.e., they increase the cutting effect of the refining surface, as a result of which fibers caught between the blade bars of oppositely positioned refining surfaces may be cut into fibers of a shorter fiber length. At the same time the refining grits improve fiber treatment caused by the refining surface to the material to be refined, such as external fibrillation of the fibers, i.e. partial detachment of outer fiber layers and fiber fraying, which increases the ability of the fibers to form fiber bonds with other fibers during the formation of a paper or board web, for example. Since the blade element comprises a protruding part protruding from the refining surface and is dimensioned to extend above the blade bars provided on the refining surface and the refining grits positioned on the top surface of the blade bars, it is possible to prevent the blade bars and/or refining grits on oppositely positioned refining surfaces of the refiner from touching one another and being subsequently damaged.

According to an embodiment, the protruding part has a top surface and the top surface is provided with a bevel arranged to guide the fibrous material to be refined and steam generated in the refining toward the top surface of the refining surface.

According to an embodiment, the refining surface of the blade element comprises first blade bars and first blade grooves between them, and second blade bars on the top surface of the first blade bars and second blade grooves between them, the second blade grooves interconnecting the first blade grooves between the first blade bars. Further, the top surface of at least one second blade bar is provided with refining grits.

The second blade bars to be formed to the top surface of the first blade bars and the second blade grooves between them form what are known as micro blades, thus increasing the cutting length of the refining surface of the blade element, the total length of the edges of the second blade bars being significantly greater than the reduced total length of the edges of first blade bars caused by the second blade bars and the second blade grooves formed to the top surface of the first blade bars. The fiber treatment by the refining surface may be further improved and the cutting length increased by providing the top surface of the second blade bars with refining grits.

According to an embodiment, at least some of the refining grits are arranged to the top surface of the blade bar to form an irregular arrangement.

According to an embodiment, at least some of the refining grits are arranged to the top surface of the blade bar to form a regular arrangement.

According to an embodiment, the refining grits are arranged to the top surface of a blade bar of the blade element in such a manner that the top surface of the blade bar comprises a one or more refining grit lines or rows at a distance from one another, separate refining grits in a refining grit line or row being placed one after the other or next to one another.

According to an embodiment, at least some of the refining grits have a regular shape.

According to an embodiment, a refining grit is a polyhedron in shape.

DESCRIPTION OF THE PREFERRED EMBODIMENTS

Figure 1:
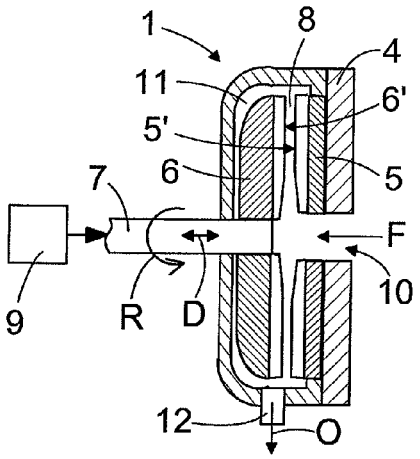
FIG. 1 is a schematic side view of a disc refiner in cross-section.

For the sake of clarity, the figures show some embodiments of the invention in a simplified manner. Like reference numerals identify like elements in the figures.

FIG. 1 is a schematic cross-sectional side view of a disc refiner 1. The disc refiner 1 has a disc-like first refining element 5, which in the embodiment of FIG. 1 is fixedly supported against a frame 4 of the refiner 1, the first refining element 5 thus forming a fixed refining element 5 of the refiner, i.e. a stator 5 of the refiner. Further, the disc refiner 1 is provided with a disc-like second refining element 6, i.e. a moving refining element 6 or a refiner rotor 6, rotatable via a shaft 7. The first refining element 5 includes a first refining surface 5' of the refiner 1 and the second refining element 6 includes a second refining surface 6' of the refiner 1. The first refining element 5 and the second refining element 6 are arranged at a distance from one another and oppositely to one another, the first refining surface 5' and the second refining surface 6' being opposite to one another, i.e. facing each other. The distance between the first refining element 5 and the second refining element 6 is equal to the refiner's blade gap. The refiner blade gap together with the blade pattern of the first refining surface 5' and the blade pattern of the second refining surface 6' forms a refining space 8 of the refiner 1, in which the fibrous material supplied into the refiner is refined as the refining elements move in relation to one another, the second refining element 6 rotating via the shaft 7 in a direction of rotation depicted by arrow R, for example. For the sake of clarity, FIG. 1 does not show the rotation motor used for rotating the shaft 1. FIG. 1 further shows a loading device 9, which is coupled to act on the second refining element 6 via the shaft 7 so as to allow the element to be moved in the direction of the shaft 7 as depicted by arrow D in relation to the first refining element 5 for adjusting the blade gap between them.

The fibrous lignocellulose-containing material, such as a wood material, to be defibrated is supplied into the refining space 8 in the form of a pulp suspension consisting of a mixture of fibrous material and water through a supply opening 10 provided in the middle of the first refining element 5 in a manner schematically depicted by arrow F. In the refining space 8 the fibrous material becomes defibrated and ground at the same as the water contained in the material evaporates. The material to be refined moves onward in the refining space 8 toward the periphery of the refining elements 5, 6 as a result of a rotating motion of the second refining element 6 and an internal pressure caused by it in the refiner. The defibrated lignocellulose-containing material exits the refining space 8 from the periphery of the refining elements 5, 6 into a refining chamber 11 and continues out of the refining chamber 11 and the entire refiner 1 through a discharge channel 12 as depicted schematically by arrow O.

Figure 2:
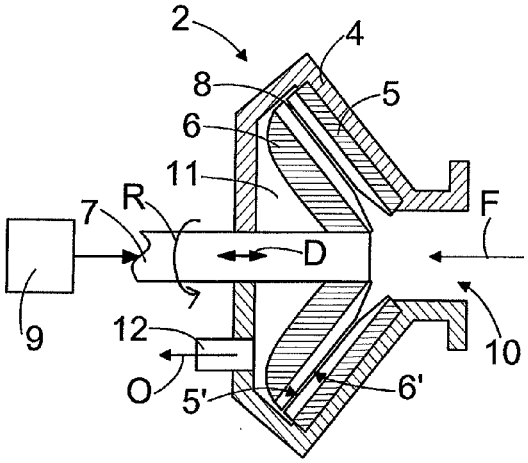
FIG. 2 is a schematic side view of a cone refiner in cross-section.

FIG. 2 is a schematic side view of a cone refiner 2 in cross-section. The structure and operating principle of the cone refiner 2 of FIG. 2 correspond to those of the disc refiner 1 of FIG. 1 except for the outer appearance of the refining elements 5, 6, the refining elements 5, 6 in the cone refiner 2 being conical whereas in the disc refiner 1 they are disc-like.

In addition to the disc refiner of FIG. 1 and the cone refiner of FIG. 2, also disc-cone refiners are used, in which the inner circle of the refiner 1 comprises disc-like refining elements and the periphery of the refiner comprises conical refining elements, in which the end of the conical refining elements with a smaller diameter is directed toward the periphery of the disc-like refining elements.

Figure 3:
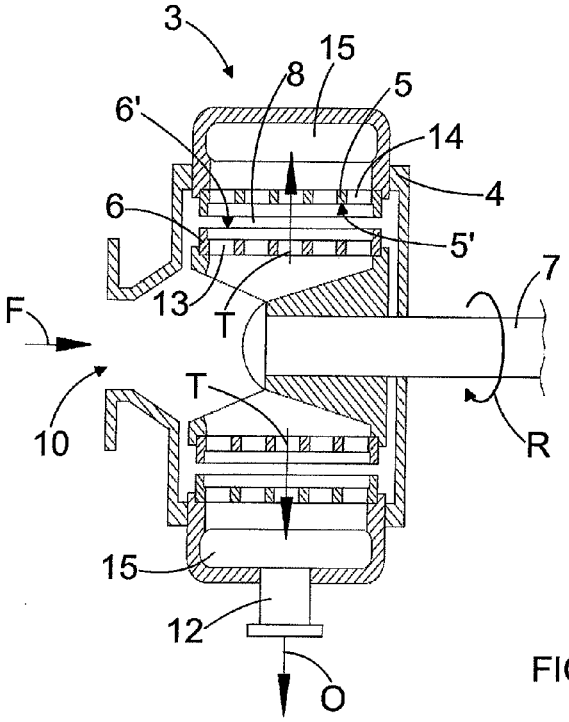
FIG. 3 is a schematic side view of a cylindrical refiner in cross-section.

FIG. 3 is a schematic cross-sectional side view of a cylindrical refiner 3. The cylindrical refiner 3 has a cylindrical first refining element 5, which in the embodiment of FIG. 3 is fixedly supported against the frame 4 of the refiner 1, the first refining element 5 thus forming the stator 5 of the refiner. Further, the cylindrical refiner 3 is provided with a cylindrical second refining element 6, i.e. the refiner rotor 6, rotatable via the shaft 7. The first refining element 5 includes a first refining surface 5' of the refiner 1 and the second refining element 6 includes a second refining surface 6' of the refiner 1. The first refining element 5 and the second refining element 6 are arranged at a distance from one another and oppositely to one another, the first refining surface 5' and the second refining surface 6' being opposite to one another, i.e. facing each other. The distance between the first refining element 5 and the second refining element 6 is equal to the refiner's blade gap. The refiner blade gap together with the blade pattern of the first refining surface 5' and the blade pattern of the second refining surface 6' forms a refining space 8 of the refiner 1, in which the fibrous material supplied into the refiner is refined as the refining elements move in relation to one another, the second refining element 6 rotating via the shaft 7 for example in a direction of rotation depicted by arrow R. For the sake of clarity, FIG. 1 does not show the rotation motor used for rotating the shaft 1.

The cylindrical refiner 3 may further comprise an adjustment structure for adjusting the blade gap between the first refining element 5 and the second refining element 6. The adjustment may be carried out in manners known per se by means of a screw or wedge mechanism or a hydraulic loading mechanism, for example, by adjusting the distance of at least one refining surface from the second refining surface.

The fibrous material to be refined is supplied into the refiner 3 through the supply opening 10 in a manner shown schematically by arrow F. Most of the fibrous material supplied into the refiner 3 moves as depicted by arrows T through openings 13 formed through the refining surface 6' of the rotor 6 into the refining space 8 between the stator 5 and the rotor 6 for refining fibrous material. Material already refined, in turn, can move through openings 14 in the refining surface 5' of the stator 5—also in the manner schematically depicted by arrows T—into an intermediate space 15 between the frame 4 of the refiner 3 and the stator 5, from where the refined material is discharged through a discharge channel 12 out of the refiner 3 in a manner schematically shown by arrow O.

Since the area between the rotor 6 and the frame 4 of the refiner 3 in the refiner 3 of FIG. 3 is not completely closed, some of the fibrous material to be supplied into the refiner 3 may move into the refining space 8 also from the end of the refining elements 5, 6 on the left-hand side, as seen in FIG. 3. Material already refined may also exit the refining space 8 from the end of the refining elements 5, 6 on the right-hand side, as seen in FIG. 3, from where there is a connection to an intermediate space 15 between the frame 4 of the refiner 3 and the stator 5.

In the refiner 3 of FIG. 3 the direction of flow of the fibrous material in the refiner 3 may also be opposite to that shown in FIG. 3. In that case the positions of the supply opening 10 and the discharge channel 12 may change places with each other, i.e. the fibrous material to be refined moves into the refining space 8 through the openings 14 in the refining surface 5' of the stator 5 and exits the refining space 8 through the openings 13 in the refining surface 6' of the rotor 6.

Unlike in FIG. 3, the cylindrical refiner may also be implemented without the refining surface 6' of the rotor 6 comprising any openings 13 formed through it and without the refining surface 5' of the stator 5 of the refiner comprising any openings 14 formed through it. In that case the fibrous material to be refined is supplied into the refining space between the refining elements 5 and 6 e.g. from the left-hand side end of the refine elements 5, 6, as seen in FIG. 3, and the already refined material exits the refining space, e.g. from the right-hand side end of the refining elements 5, 6, as seen in FIG. 3. In that case the discharge channel 12 is arranged to the right-hand side end of the refiner 3, as seen in FIG. 3.

Moreover, the cylinder refiner may also be implemented, unlike in FIG. 3, with openings formed only through either the refining surface 6' of the rotor 6 or the refining surface 5' of the stator 5. Depending on the implementation of the refiner, in that case the openings may act as openings supplying material to be refined into the refining space or openings discharging already refined material from the refining space.

In the cylindrical refiner 3 of FIG. 3 the openings 14 provided through the refining surface 5' of the stator 5 and the openings 13 provided through the refining surface 6' of the rotor 6 may also be used in connection with the disc refiners, cone refiners or disc-cone refiners presented above, in which case openings 13,14 may be provided either on the refining surface 5' of the stator 5 or on the refining surface 6' of the rotor 6 or both on the refining surface 5' of the stator 5 and the refining surface 6' of the rotor 6.

Figure 4:
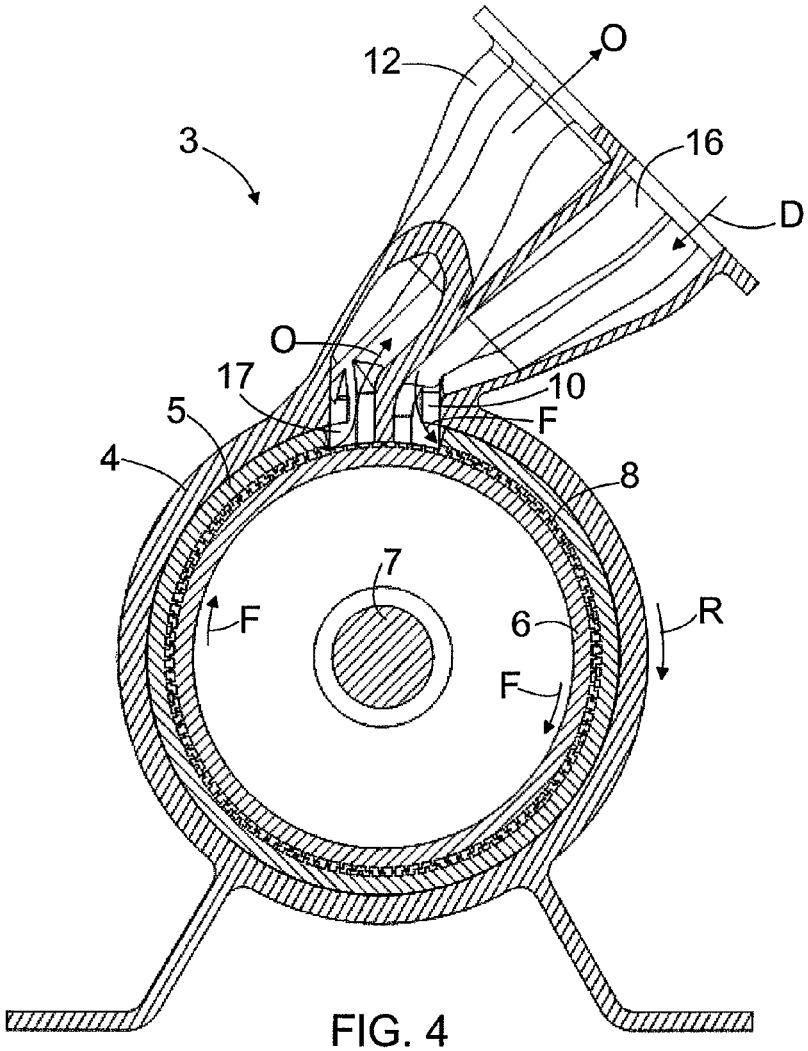
FIG. 4 is a schematic side view of a second cylindrical refiner in cross-section.

FIG. 4 is a schematic end view of a second cylindrical refiner 3 in cross-section. The cylindrical refiner 3 comprises a frame 4. The cylindrical refiner 3 further includes a fixed first cylindrical refining element 5, i.e. the refiner stator 5, supported against the frame 4 and a rotatable second cylindrical refining element 6, i.e. the refiner rotor 6, facing the first refining element 5. The fixed refining element 5 has a first refining surface 5' of the refiner 3 and the rotatable refining element 6 has a blade surface 6', i.e. a refining surface 6', which forms a second refining surface 6' of the refiner. The rotatable refining element 6 is rotated by a shaft 7 fastened thereto and a rotation motor not shown in the figures.

The material to be refined is supplied into the refining space 8 from the side of the fixed refining element 5 through the supply opening 10 provided in the frame 4 of the refiner 3, a supply channel 16 connecting the opening to a process step preceding the refiner. The material refined in the refiner 3 is removed from the refining space 8 through a discharge opening 17 provided on the side of the fixed refining element 5 in the frame 4 of the refiner 3, a discharge channel 12 connecting the opening to a process step following the refiner 3. The supply opening 10 and the discharge opening 17 are thus located on the frame 4 of the refiner 3, on the periphery of the refiner 3, in the direction of the rear side of the fixed refining element 5, or, in other words, the supply opening 10 and the discharge opening 17 are located on the side of the fixed refining element 5 in relation to the refining space 8 so that the discharge opening 17 is at a distance from the supply opening 10 in a direction of rotation R of the rotating refining element 6. The supply opening 10 and the discharge opening 17 are separated from one another by a structure belonging to the frame 4 of the refiner 3 so that the fiber material to be supplied into the refiner 3 and the fiber material to be discharged from the refiner 3 cannot become mixed with one another.

When the cylindrical refiner 3 of FIG. 4 is being used, the rotatable refining element 6 is rotated in relation to the fixed refining element 5 in the direction of rotation depicted by arrow R. The material to be defibrated is supplied into the refining space 8 through the supply opening 10 in the form of a pulp suspension formed of a mixture of fiber material and water. From the supply opening 10 the material to be defibrated moves into the refining space 8 between the fixed refining element 5 and the rotatable refining element 6. The direction of supply and movement of the material to be defibrated in the refiner 3 is depicted schematically by arrow F. The rotation of the rotatable refining element 6 causes in the refining space 8 a pressure which together with the rotation of the rotating refining element 6 moves the material to be refined onward in the refining space 8 in the direction of rotation of the rotating refining element 6, i.e. from the supply opening 10 toward the discharge opening 17. When the material to be refined reaches the discharge opening 17, the refined fibrous material exits the refiner 3 through the discharge opening 17 and the discharge channel 12 as depicted schematically by arrow O.

FIGS. 5 to 8 show some blade elements that may be used for forming the refining surface 5' of the fixed refining element 5 or the refining surface 6' of the rotatable refining element 6 in a cone refiner of the type shown in FIG. 2 or on a conical portion of a disc-cone refiner, for example.

The blade elements shown in FIGS. 5 to 8 may thus be arranged to form a part of e.g. the refining surface 5' of the stator 5 of the cone refiner 2 or the refining surface 6' of the rotor 6 thereof, in which case the blade element is often referred to as a blade segment. In that case the entire refining surface 5' of the stator 5 or the entire refining surface 6' of the rotor 6 are achieved by arranging two or more blade elements, typically of a corresponding shape, side by side in the direction of the periphery of the stator 5 or the rotor 6, and possibly also in the direction of the shaft 7 of the refiner 2. Alternatively, the refining surface 5' of the stator 5 or the refining surface 6' of the rotor 6 may be formed of a single blade element in the shape of a truncated cone, in which case the refining surface of the blade element in question alone entirely forms an entire or complete refining surface 5', 6' of the conical stator 5 or rotor 6 both in the circumferential direction of the refining element and in the axial direction of the refiner. Correspondingly, a complete or an entire refining surface in disc or cylindrical refiners may also consist of only one blade element in the form of a cylinder or a disc or a ring, or of two or more blade elements positioned side by side.

In a fixed refining element, the one or more blade elements may be fastened to a separate body structure of the fixed refining element, the body structure being, in turn, fastened to the refiner frame. Alternatively, said one or more blade elements may be fastened directly to the refiner frame, the frame structure of the refiner thus forming also the body structure of the fixed refining element. Said one or more blade elements in the rotatable refining element are fastened to the body structure of the rotatable refining element, in connection with which the shaft is arranged.

Figure 5:
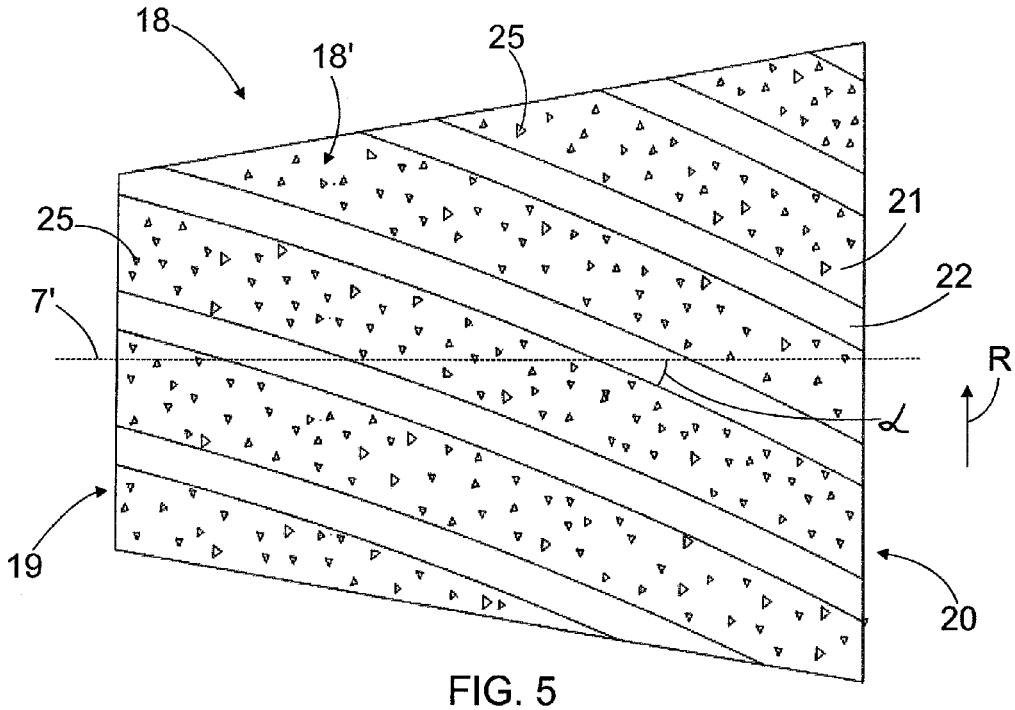
FIG. 5 is a schematic view of a blade element seen in the direction of the refining surface of the blade element.

FIG. 5 is a schematic view of a blade element 18 seen in the direction of the refining surface 18' of the blade element 18. The blade element 18 has a first end 19 and a second end 20. The first end 19 of the blade element 18 is arranged to be directed toward the end of the conical refining element with the smaller diameter and the second end 20 of the blade element 18 is arranged to be directed toward the end of the conical refining element with the greater diameter. The direction of rotation of the rotatable refining element in relation to the blade element 18 is schematically depicted by arrow R.

The refining surface 18' of the blade element 18 comprises blade bars 21 and blade grooves 22 between them, the blade bars and the blade grooves running from the direction of the first end 19 of the blade element 18 toward the second end 20 of the blade element 18. The direction of travel of the blade bars 21 and the blade grooves 22 corresponds to the length direction of the blade bars 21 and the blade grooves 22, the width direction of the blade bars 21 and the blade grooves 22 being substantially transverse to said length direction. The blade bars 21 produce a refining effect on the fibrous material to be refined and the blade grooves 22 carry the material to be refined onward on the refining surface 18'. Further, the top surface of the blade bars 21 is provided with refining particles 25, i.e., refining grits 25, in order to increase the cutting length of the refining surface 18', i.e., to increase the cutting effect of the refining surface, as a result of which fibers that are caught between blade bars of oppositely positioned refining surfaces may be cut to fibers of a shorter fiber length. At the same time, the refining grits 25 improve fiber treatment caused to the material to be refined by the refining surface 18', such as external fibrillation of the fibers, i.e. partial detachment of outer fiber layers and fiber defraying, which increases the ability of the fibers to form bonds with other fibers during the formation of a paper or board web, for example.

The refining grits may be metal or ceramic particles, for example. Therefore the manufacturing material of the refining grits may be e.g. aluminium oxide, sintered aluminium oxide, natural or synthetic industrial diamonds, tungsten carbide, silicon carbide, zirconium(IV)oxide, cubic boron nitride and hard metal. The harder the manufacturing material used for manufacturing the refining grits, the greater is the resistance to wear of the refining grits and the refining effect of the grits on the material to be refined. The refining surface of a blade segment may comprise refining grits made of one material only or grits made of different materials. The entire refining surface of a refining element may comprise either refining grits made of one material only or refining grits made of different materials so that the different blade segments forming the entire refining surface of the refining element have refining grits made of different materials, for example.

Figure 9:
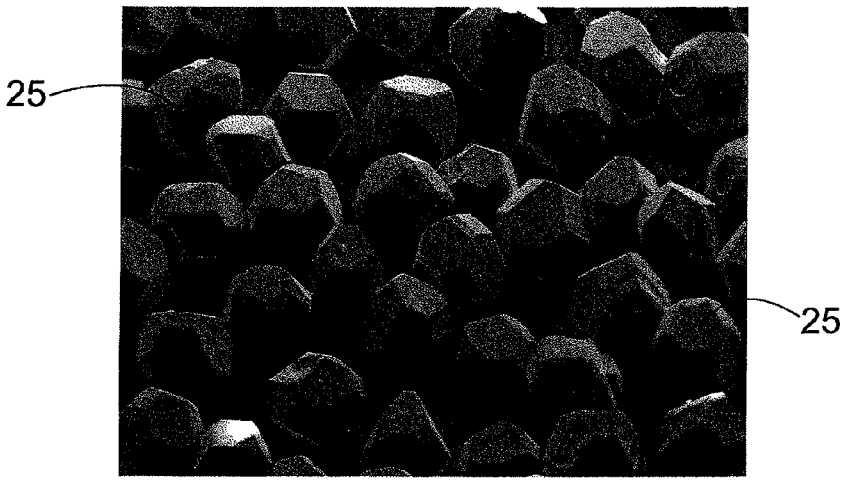
FIG. 9 shows some refining grits.
Figure 6:
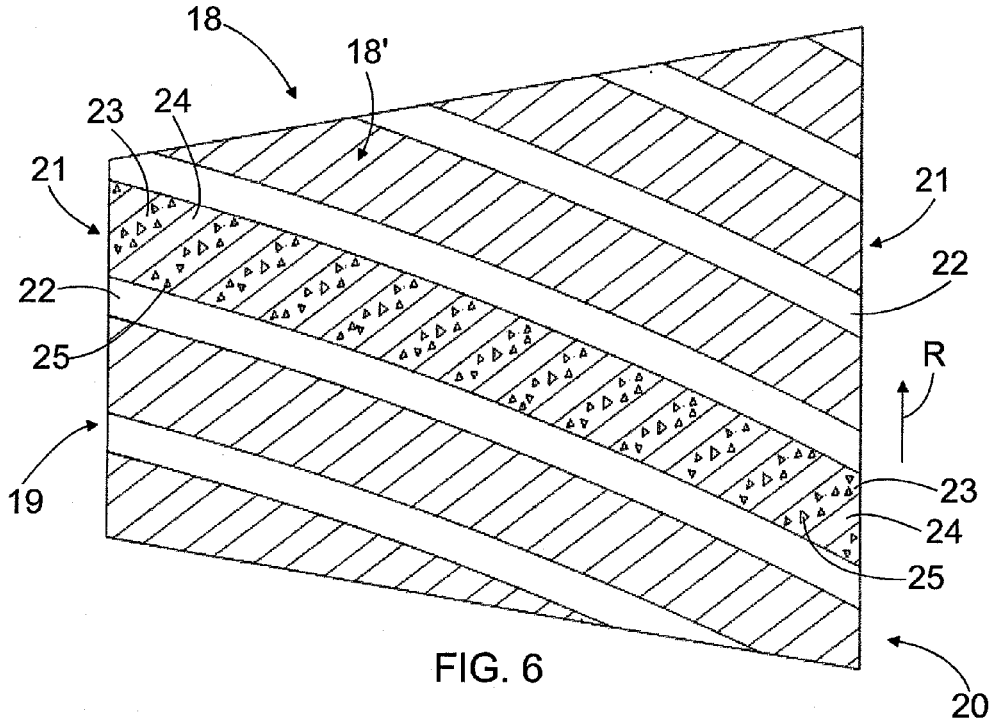
FIG. 6 is a schematic view of a second blade element seen in the direction of the refining surface of the blade element.
Figure 7:
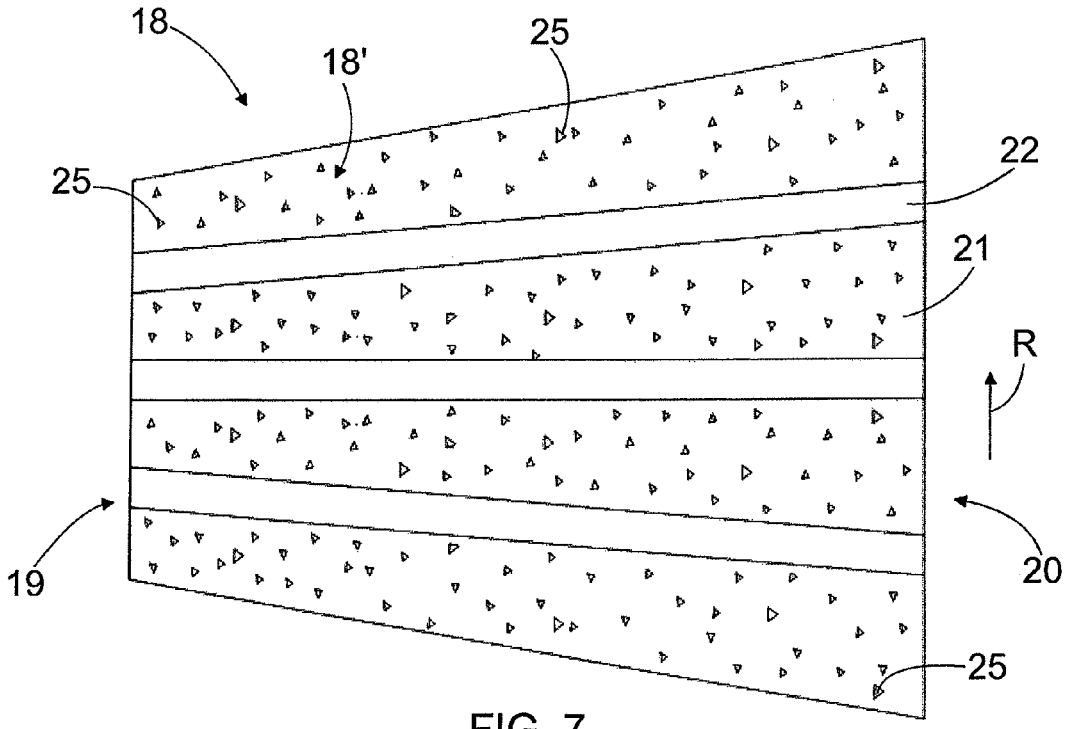
FIG. 7 is a schematic view of a third blade element seen in the direction of the refining surface of the blade element.
Figure 8:
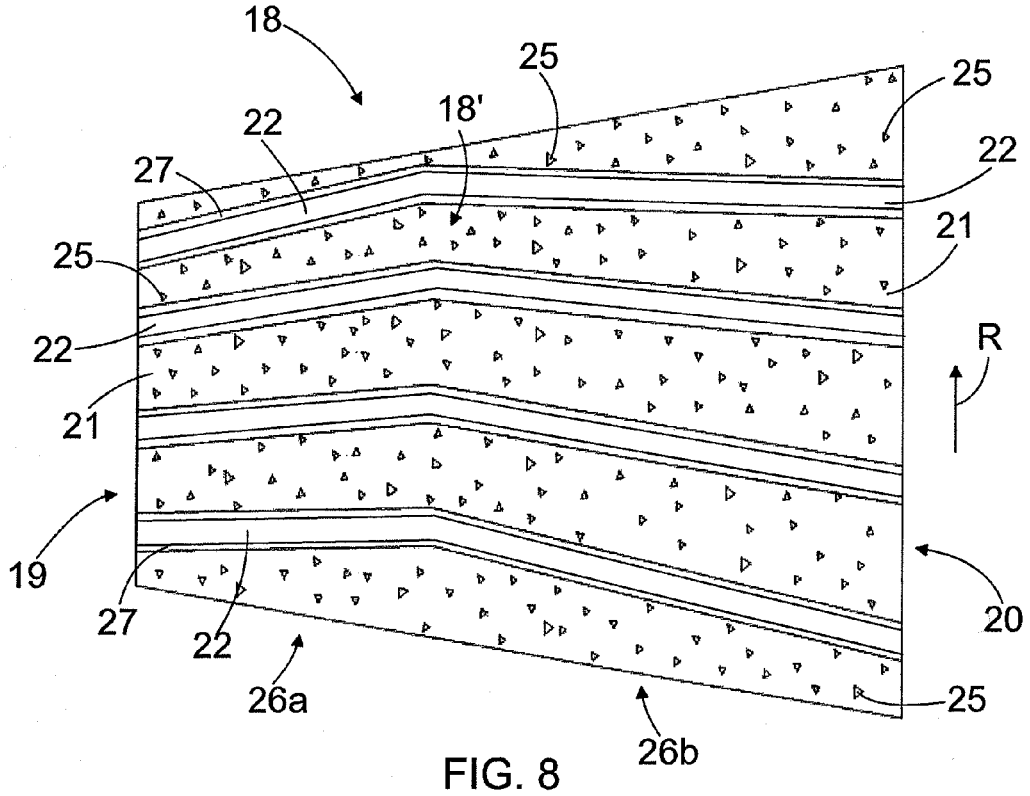
FIG. 8 is a schematic view of a fourth blade element seen in the direction of the refining surface of the blade element.

In the example of FIG. 5, similarly as in those of FIGS. 6 to 8, the refining grits 25 are shown schematically as triangular particles. In practical embodiments the refining grits may be shaped in various ways. The refining grits may have a regular or an irregular shape. The refining grits may be polyhedrons or polygonal or nearly round polyhedrons or polygons. FIG. 9 shows a set of polyhedral refining grits 25 of twelve faces. Refining grits in the shape of a hemisphere are also possible. The shaping of the refining grits allows the cutting effect of the refining grits on the material to be refined to be acted on. Refining grits provided with rounded face edges tend to detach the fibers of the material to be refined from one another without causing the fibers to be cut to shorter fibers, whereas refining grits provided with sharp-edged faces tend to cut the fibers shorter and thus have an effect on the fiber length.

Also the positioning of the refining grits on the refining surface may be used to act on the refining effect caused by the refining grits on the material to be refined or on the operation of the refiner. The refining grits may be positioned on the refining surface either according to a regular or an irregular positioning or pattern or design, for example in relation to the direction of rotation of the rotatable refining element. When placed into a regular positioning or pattern, the refining grits may be placed side by side at a distance from one another in the direction of an imaginary line, for example, which line may be at an angle to the direction of rotation of the refining element to be rotated. In both the regular and the irregular pattern design, the distance of the refining grits from one another on the refining surface may vary in the different blade segments depending on the intended refining effect of the refining surface of the blade segment.

Also the size of the refining grits 25 may vary depending on, e.g. what kind of fiber treatment effect is to be directed to the material to be refined. Hence the size or diameter of the refining grits may be 3 to 700 micrometres, for example. The greater the size of individual refining grits, the smaller is the amount of treatment directed by one refining grit on an individual fiber. An advantageous total effect of fiber length and external fibrillation of fibers with regard to the strength of a paper or board web to be manufactured is achievable by refining grits having a size of 100 to 500 micrometres.

When the fibrous material to be refined is modified with a particular intention of producing external fibrillation of the fiber material, i.e. microfibrillation of fiber surfaces, it is advantageous to use refining grits of a smaller refining grit size, for example less than 100 micrometres. If internal fibrillation, with loosening of internal fiber structure, fiber layering, detachment of fiber layers, buckling and defibration, is particularly aimed at, a greater refining grit size, for example greater than 100 micrometres, is advantageous.

The distance between the refining grits is preferably 1 to 5 times the diameter of a refining grit, the refining surface thus being effective as a blade surface defibrating and refining or modifying the fiber or the fiber surface.

Also the attachment of the refining grits to the refining surface may vary. The refining grits 25 may be attached to the refining surface e.g. by thermal spraying, galvanic coating, inverse galvanic coating, vacuum brazing, coating by gas welding, laser coating or sintering.

The blade bars 21 and blade grooves 22 in the blade element 18 of FIG. 5 are relatively wide, which means that the cutting length of the blade element 18 and the blade grooves 21 remains relatively short in comparison to the surface area of the refining surface 18' of the blade element 18, the refining grits arranged to the top surface of the blade bars 21 providing means for both easily increasing the cutting length of the blade bars 21 of the blade element 18 and improving the fiber treatment effect of the refining surface 18' on the fibers.

Moreover, in the blade element 18 of FIG. 5 the blade bars 21 and the blade grooves 22 are arranged to run in a curved manner from the direction of the first end 19 of the blade element 18 toward the second end 20 of the blade element 18 so that between the blade bars 21 and a projection 7' of the refiner shaft 7 on the refining surface 18' there is an angle $\alpha$, i.e. a blade angle $\alpha$, having a value different from the value of zero degrees. If the blade element 18 is arranged as a part of the rotatable refining element of the refiner, the blade angle tends to enhance the flow of the material to be refined from the refining element end of the smaller diameter to the direction of the refining element end of the greater diameter. If the blade element 18 is arranged as a part of the rotatable refining element of the refiner, said blade angle tends to slow down or restrain the flow of the material to be refined from the refining element end of the smaller diameter to the direction of the refining element end of the greater diameter. The direction of curvature and the radius of curvature of the blade bars 21 and the blade grooves 22 may differ from those shown in FIG. 5. The refining surface 18' of one blade element 18 may also comprise blade bars 21 and blade grooves 22 of different radii of curvature in a plurality of different directions. By varying the direction of curvature and the radius of curvature of the blade bars 21 and the blade grooves 22 it is possible to act on the distribution of the material to be refined in the blade gap.

FIG. 6 is a schematic view of a second blade element 18 seen in the direction of its refining surface 18'. The refining surface 18' of the blade element 18 of FIG. 6 comprises blade bars 21 and blade grooves 22 between them, the blade bars 21 and the blade grooves 22 running from the direction of the first end 19 of the blade element 18 toward the second end 20 of the blade element 18. The top surface of the blade bars 21 further comprises blade bars 23 and blade grooves 24 between them. The refining surface 18' of the blade element 18 of FIG. 6 thus comprises first blade bars 21 and second blade bars 22 between them, and second blade bars 23 on the top surface of the first blade bars 21 and second blade grooves 24 between them. The width of the second blade bars 23 is smaller than that of the first blade bars 21, and the width of the second blade grooves 24 is smaller than that of the first blade grooves 22. The second blade bars 23 and the second blade grooves 24 form what are known as micro blades. The second blade bars 23 and the second blade grooves 24 may be positioned on the top surface of the first blade bars 21 to run parallel with the first blade bars 21 and the first blade grooves 22, although the second blade bars 23 and the second blade grooves 24 are typically positioned on the top surface of the blade bars 21 at an angle to the direction of travel of the first blade bars 21 and the first blade grooves 22, as shown in FIG. 6, the second blade grooves 24 connecting together the first blade grooves 22 next to one another. In the blade element 18 of FIG. 6 the second blade bars 23 and the second blade grooves 24 are substantially straight in their direction of travel, although they could also be curved in their direction of travel.

By providing the top surface of the first blade bars 21 with second blade bars 23 and second blade grooves 24 as shown in FIG. 6, the cutting length of the refining surface 18' of the blade element 18 may be increased in comparison with the blade pattern of the blade bars 21 and the blade grooves 22 shown in FIG. 6.

FIG. 6 further shows refining grits 25 placed to the top surface of the second blade bars 23, which allow the cutting length of the refining surface shown in FIG. 6 to be further increased and the fiber treatment to be improved. Refining grits 25 may be placed to the top surface of the second blade bars 23 only on a restricted portion of the refining surface 18' of the blade element 18, as shown in FIG. 6, or on the entire refining surface 18'.

FIG. 7 is a schematic view of a third blade element 18 seen in the direction of its refining surface 18'. The refining surface 18' of the blade element 18 comprises blade bars 21 and blade grooves 22 between them. The top surface of the blade bars 21 is further provided with refining grits 25.

Further, in the blade element 18 of FIG. 7 the blade bars 21 and the blade grooves 22 are arranged to run substantially straight from the direction of the first end 19 of the blade element 18 toward the second end 20 of the blade element 19 so that the blade bars 21 and the projection 7' of the refiner shaft 7 on the refining surface 18' are substantially parallel, the blade angle α of the blade bars 21 being about zero degrees. Hence the blade element of FIG. 7 placed into the refiner does not have any specific enhancing or restricting effect on the flow of the material to be refined in the direction between the first end 19 and the second end 20 of the blade element 18.

FIG. 8 is a schematic view of a fourth blade element 18 seen in the direction of its refining surface 18'. The refining surface 18' of the blade element 18 comprises blade bars 21 and blade grooves 22 between them, and refining grits 25 placed to the top surface of the blade bars 21.

The blade element 18 of FIG. 8 comprises two refining surface portions 26*a* and 26*b* in the direction between the first end 19 and the second end 20 of the blade element, the blade bar angle a of the blade bars 21 on a first refining surface portion 26*a* on the side of the first end 19 of the blade element 18 having a reverse direction in relation to the blade bar angle α of the blade bars 21 on a second refining surface portion 26*b* on the side of the second end 20 of the blade element 18. The blade bars 21 and the blade grooves 22 thus form a structure in the shape of a V-angle on the refining surface. If the blade element 18 is arranged as a part of the rotatable refining element of the refiner, the blade bars 21 on the first refining surface portion 26*a* tend to restrain the flow of the material to be refined from the direction of the refining element end of the smaller diameter toward the refining element end of the greater diameter, whereas the blade bars 21 on the second refining surface portion 26*b* tend to enhance the flow of the material to be refined from the direction of the refining element end with the smaller diameter toward the refining element end with the greater diameter. If the blade element 18 is arranged as a part of the fixed refining element of the refiner, the blade bars 21 on the first refining surface portion 26*a* tend to enhance the flow of the material to be refined from the direction of the refining element end with the smaller diameter toward the refining element end with the greater diameter, whereas the blade bars 21 on the second refining surface portion 26*b* tend to restrain the flow of the material to be refined from the direction of the refining element end with the smaller diameter toward the refining element end with the greater diameter.

In FIG. 8 the tip of the V-angle formed by the blade bars 21 and the blade grooves 22 sets closer to the first end 19 of the blade element than to the second end 20. However, the position of the V-angle in the axial direction of the refiner may vary, i.e. the ratio between the surface areas of the first refining surface portion 26*a* and the second refining surface portion 26*b* may vary from that shown in FIG. 8.

In addition, the blade grooves 22 in the blade element of FIG. 8 have edges with a bevelling such that the width of the blade groove 22 is smaller at the bottom of the blade groove 22 than on the level of the top surface of the blade bar 21, i.e. the sides of the blade bars 21 have an inclined portion 27, or a bevel 27, upwards from the bottom of the blade groove 22 toward the top surface of the blade bar 21. Said bevel enhances the transfer of the material to be refined from the blade grooves 22 to the top surface of the blade bars 21 between the oppositely positioned refining surfaces, i.e. into the refining space of the refiner. The bevel may also be used in blade elements according to FIGS. 5 to 7.

Figure 10:
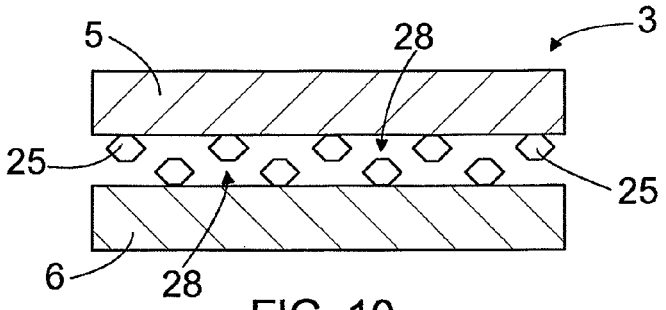
FIG. 10 is a schematic side view of a third cylindrical refiner in cross-section.
Figure 11A:
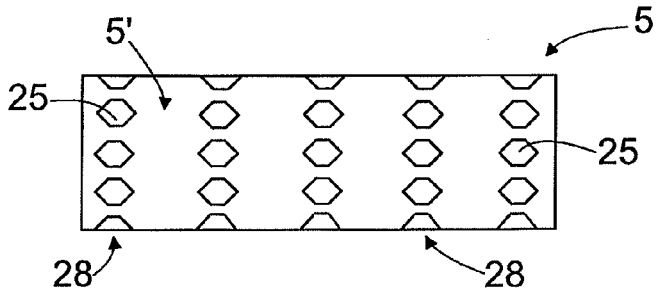
FIG. 11*a* is a schematic view of a stator of the cylindrical refiner of FIG. 10, seen in the direction of the refining surface thereof.
Figure 11B:
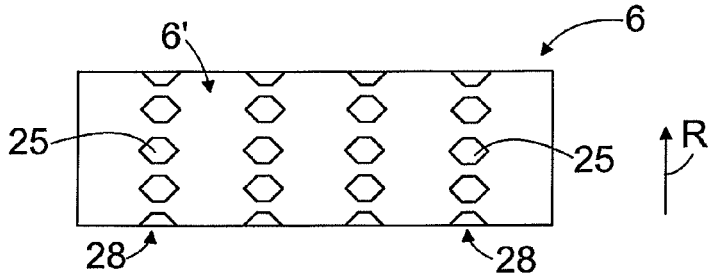
FIG. 11*b* is a schematic view of a rotor of the cylindrical refiner of FIG. 10, seen in the direction of the refining surface thereof.

FIG. 10 is a schematic side view of a third cylindrical refiner 3 in cross-section, FIG. 11*a* is a schematic view of the stator 5 of the cylindrical refiner 3 of FIG. 10, seen in the direction of the refining surface 5', and FIG. 11*b* is a schematic view of the rotor 6 of the cylindrical refiner of FIG. 10 seen in the direction of its refining surface 6'. For the sake of clarity, FIGS. 10, 11*a* and 11*b* do not show the grooves in the refining surface 5', 6', but according to the embodiments of FIGS. 10, 11*a* and 11*b* both the refining surface 5' of the stator 5 and the refining surface 6' of the rotor 6 may comprise either only first blade bars 21 and first blade grooves 22 between them or both first blade bars 21 and first blade grooves 22 between them, and second blade bars 23 on the top surface of the first blade bars 21 and second blade grooves 24 between them.

In the embodiment of FIGS. 10, 11*a* and 11*b* the top surface of the blade bars 21 or 23 is further provided with refining grits 25. The refining grits 25 are arranged to the refining surfaces 5', 6' of the stator 5 and the rotor 6 one after the other or side by side in the direction of the periphery of the refining elements 5, 6 so that the refining grits 25 form tracks 28 parallel with the periphery of the refining elements 5, 6, the tracks 28 in the stator 5 being parallel with the inner circle of the stator 5 and the tracks 28 in the rotor 6 being parallel with the periphery of the rotor 6. Thus, the refining grit tracks 28 are refining grit lines or rows 28, in which the individual refining grits 25 are placed one after the other or next to each other. In the direction of the shaft of the refiner 3, which in FIGS. 10, 11*a* and 11*b* would thus run horizontally from left to right, the tracks 28 formed of the refining grits 25 are arranged so that their distance from the ends of the refining elements 5, 6 differs from one another, the refining grit tracks 28 of the stator 5 and the rotor 6 thus being interleaved. In other words, in the refiner 3 of FIGS. 10, 11*a* and 11*b* the refining grit tracks 28 are arranged side by side on the refining surfaces 5', 6' of the opposite positioned refining elements 5, 6 so that the refining grit tracks 28 are arranged onto oppositely positioned refining surfaces at distances differing from one another in a direction parallel to the plane of the refining surface 5', 6' and substantially transverse in relation to the mutual direction of motion of the refining elements, which direction may be shown by arrow R that depicts the direction of rotation of the rotor 6. One refining element may have one or more refining grit tracks 28.

In addition to cylindrical refiners, also cone refiners and disc refiners may be provided with corresponding refining grit tracks 28. In cone refiners the refining grit tracks 28 are formed in a similar manner as in cylindrical refiners. In disc refiners the refining grit tracks 28 are formed to the refining surfaces of disc-like refining elements at different distances from the center point of the refining elements, each refining grit track 28 forming an annular arrangement on the refining surface. Thus, also in that case the refining grit tracks on oppositely positioned refining surfaces of both cone refiners and disc refiners are formed so that they are arranged on the oppositely positioned refining surfaces at different distances in a direction that is parallel to the plane of the refining surface 5', 6' and substantially transverse in relation to the direction of motion of the refining elements in relation to one another.

Refining grits 25 placed on oppositely positioned refining surfaces in the form of interleaved tracks enables to prevent the wear, damaging or detachment of the refining grits caused by the oppositely positioned refining surface possibly touching one another.

Figure 12:
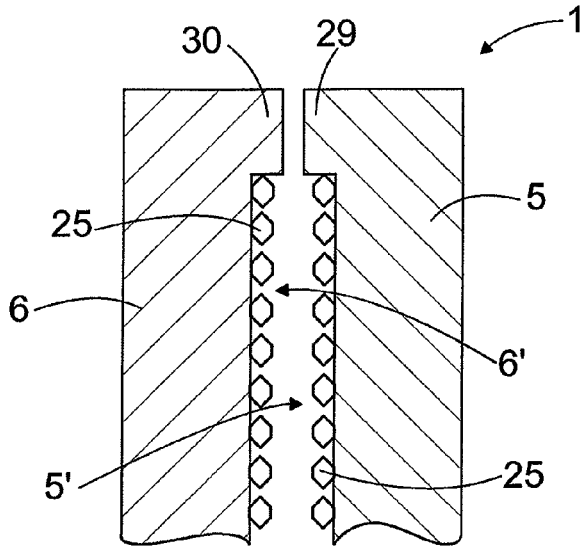
FIG. 12 is a schematic side view of a second disc refiner in cross-section.

FIG. 12 is a schematic side view of a second disc refiner 1 in cross-section. For the sake of clarity, FIG. 12 does not show the grooves of the refining surfaces 5', 6' of the stator 5 and the rotor 6, but in the embodiment of FIG. 12 both the refining surface 5' of the stator 5 and the refining surface 6' of the rotor 6 may comprise either only first blade bars 21 and first blade grooves 22 between them or both first blade bars 21 and first blade grooves 22 between them and second blade bars 23 on the top surface of the first blade bars 21 and second blade grooves 24 between them. FIG. 12 further shows schematically the refining grits arranged to the top surface of the blade bars of the refining surface 5', 6'.

Further still, in the embodiment of FIG. 12 the stator 5 comprises on its periphery a protruding part 29 extending away from the refining surface 5', and the rotor 6 comprises on its periphery a protruding part 30 extending away from the refining surface 6', the protruding parts 29 and 30 thus being opposite to one another and extending toward one another. Said protruding parts 29 and 30 are dimensioned so that in the height direction of the blade arrangement of the refining surfaces 5', 6' the protruding parts 29 and 30 extend above the blade bars and blade grooves on the refining surfaces 5', 6' and the refining grits 25 on the top surface of the blade bars. In that case, if the refining elements 5, 6 touch one another, the protruding parts 29, 30 in question touch one another, preventing at the same time the blade bars and blade grooves on the oppositely positioned refining surfaces 5', 6' and the refining grits 25 on the top surface of the blade bars from touching one another and possibly becoming damaged.

In FIG. 12 the protruding parts 29 and 30 are placed on the periphery of the refining elements 5 and 6, although they could, alternatively, be also placed on some other portion of the refining elements 5, 6. Further, similar protruding parts may be arranged to the refining elements of cone refiners and cylindrical refiners. The protruding parts 29 and 30 may be arranged as part of the body structure of the refining elements 5, 6 or as part of a blade element arranged to the refining elements 5, 6. The refining elements 5, 6 may contain one or more of said protruding parts 29, 30. A further embodiment that is possible is one in which only the stator 5 comprises a protruding part 29 but the rotor 6 does not have a specific protruding part 30. Yet another possible embodiment is one in which only the rotor 6 comprises a protruding part 30 but the stator 5 does not have a specific protruding part 29.

A refiner of the type in FIG. 10 or 12 or a refiner combining the embodiments of FIGS. 10 and 12 may be used e.g. as a first refiner of a refiner system in refiner systems comprising a plural number of successive refiners. However, refiners of the type in FIG. 10 or 12 are also suitable for use as refiners coming after the first refiner in a refiner system. In that case the size of the refining grits 25 may be selected to be 100 to 200 micrometers, in which case an individual fiber length is subjected to a plurality of contact processing events.

In the embodiments of FIGS. 10, 11*a* and 11*b* the refining grits 25 are arranged in rows. When collision of refining grits placed on oppositely positioned refining surfaces is prevented by an adjustment of the blade gap or by a mechanical solution, such as the one in FIG. 12, the refining grits 25 may be placed to oppositely positioned refining surfaces independently of the opposite refining surface. The refining grits 25 may then be placed to the refining surface in a random order or to precisely determined positions, such as rows. When the refining grits are placed in rows, refining grits in adjacent rows may coincide with regard to the direction of movement of the refining surfaces, an example of this being shown in FIGS. 10, 11*a* and 11*b*. The refining grit rows 28 may be oriented perpendicularly to the direction of movement of the refining surface, or they may be oriented to some other direction on the refining surface.

When a refining grit row is oriented to a large or most significant extent transversely to the direction of movement of the refining surface, an advantageous solution is to place the refining grits in rows so that refining grits in adjacent rows are not aligned with respect to the direction of movement of the blade surface. In that case the refining grits in adjacent refining grit rows are placed to a new position in the refining grit direction by preferably 0.1 to 1.0 times the length of the refining grit diameter in relation to the position of the refining grits in an adjacent refining grit row. The distance between the refining grit rows is preferably 1 to 5 times the diameter of a refining grit. Compared with a solution without this kind of lateral offset, the refining surface comprising the lateral offset of the refining grit rows achieves a higher refining intensity. This advantage is gained because in the refining surface comprising the lateral offset each refining grit in the refining grit row causes a refining effect always on a new position in the material to be refined.

Figure 13:
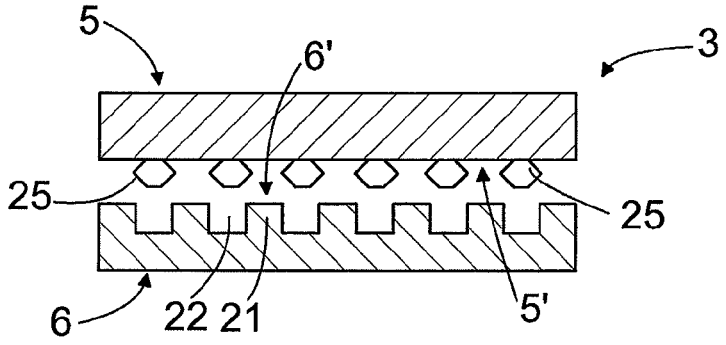
FIG. 13 is a schematic side view of a fourth cylindrical refiner in cross-section.

FIG. 13 is a schematic cross-sectional side view of a fourth cylindrical refiner 3. The cylindrical refiner 3 of FIG. 13 comprises a fixed refining element 5 and a rotatable refining element 6. The fixed refining element 5 has a refining surface 5' which is smooth and does not comprise any blade bars or blade grooves. The rotatable refining element 6 has a refining surface 6' which comprises first blade bars 21 and first blade grooves 22. The top surface of the blade bars 21 could also comprise second blade bars 23 and second blade grooves 24 between them. The refining surface 5' of the fixed refining element 5 further comprises refining grits 25 arranged to the refining surface 5'. The refining grits 25 may be positioned to the refining surface 5' by any of the means disclosed above. In the refiner 3 of FIG. 13 the one or more blade elements that form the refining surface 5' of the fixed refining element 5 are thus smooth and do not comprise any blade bars or blade grooves.

Figure 14:
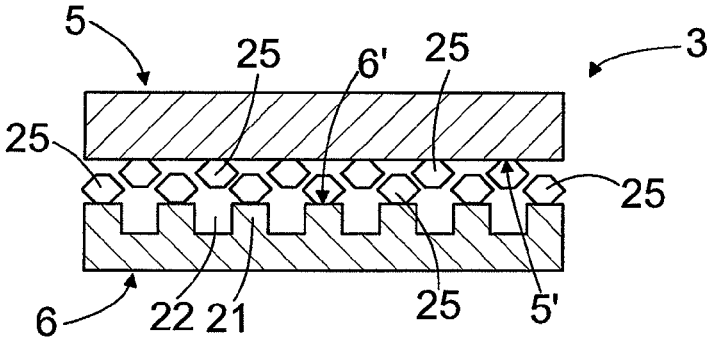
FIG. 14 is a schematic side view of a fifth cylindrical refiner in cross-section.

FIG. 14 is a schematic cross-sectional side view of a fifth cylindrical refiner 3. The cylindrical refiner 3 of FIG. 14 comprises a fixed refining element 5 and a rotatable refining element 6. The fixed refining element 5 has a refining surface 5' which is smooth and does not comprise any blade bars or blade grooves. The rotatable refining element 6 has a refining surface 6' which comprises first blade bars 21 and first blade grooves 22. The top surface of the first blade bars 21 could also comprise second blade bars 23 and second blade grooves 24 between them. Both the refining surface 5' of the fixed refining element 5 and the refining surface 6' of the rotatable refining element 6 further comprise refining grits 25 arranged to the refining surfaces 5', 6'. The refining grits 25 may be positioned to the refining surface 5' by any of the means disclosed above.

The embodiments of FIGS. 13 and 14 may also be used in connection with a disc refiner and a cone refiner. A further possible embodiment is one in which the refining surface of the fixed refining element comprises blade bars and blade grooves and in which the top surface of the blade bars may be provided with refining grits, and the refining surface of the moving refining element is smooth and does not comprise any blade bars or blade grooves, yet comprises refining grits arranged to its refining surface.

The embodiments disclosed with reference to FIGS. 13 and 14 allow a solution to be achieved in which the cutting length is particularly great and, in addition, in which the grooved second refining surface enhances a smooth transfer of the material to be refined from the supply channel through the supply opening to the refining surface and, likewise, away from the refining surface through the discharge opening into the discharge channel.

In other words, the blade elements disclosed above may be used in the refiners disclosed above to form a refining surface for the stator and/or a refining surface for the rotor. When the blade elements 18 are used for providing a stator and/or a rotor with a refining surface that comprises supply openings 13 or discharge openings 14 of FIG. 3, said supply openings 13 or discharge openings 14 may be placed to the bottom of the blade groove 22 so that the supply openings 13 or discharge openings 14 cover either a part of the bottom area of the blade groove 22 or substantially the entire bottom area of the blade groove 22. Alternatively, said supply openings 13 and/or discharge openings 14 may be placed to the refining surface so that they only set on the portion of the blade bar 21 on the refining surface or so that they set on the portion of both the blade bars 21 and the blade grooves 22 on the refining surface.

Figure 15:
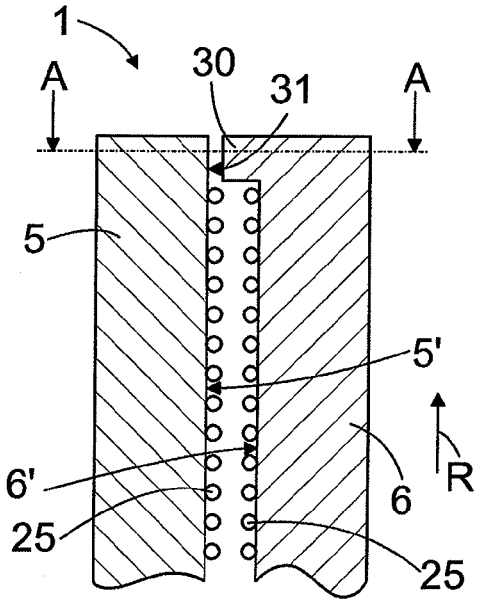
FIG. 15 is a schematic side view of a third disc refiner in cross-section.

FIG. 15 is a schematic side view of a third disc refiner 1 in cross-section. For the sake of clarity, FIG. 15 does not show the grooving of the refining surfaces 5', 6' of the stator 5 and the rotor 6, but in the embodiment of FIG. 15 both the refining surface 5' of the stator 5 and the refining surface 6' of the rotor 6 may comprise either only first blade bars 21 and first blade grooves 22 between them, or both first blade bars 21 and first blade grooves 22 between them and the second blade bars 23 on the top surface of the first blade bars 21 and second blade grooves 24 between them. FIG. 15 further shows schematically the refining grits 25 arranged to the refining surfaces 5', 6'.

Figure 16:
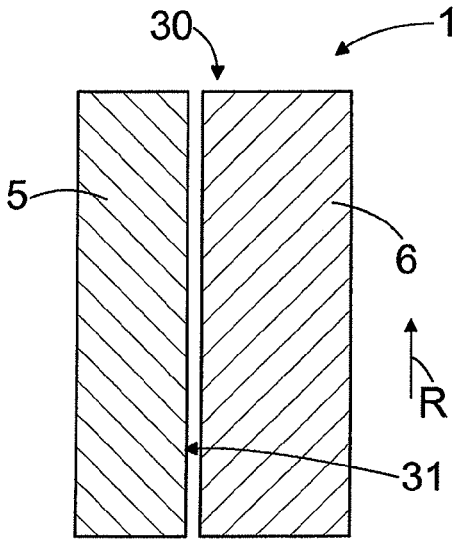
FIG. 16 is a schematic view of a detail of the disc refiner of FIG. 15 in cross-section.

The rotor 6 in the disc refiner 1 of FIG. 15 comprises at a periphery a protruding part 30 oriented away from the refining surface 6'. The protruding part 30 may extend either entirely or partly around the periphery of the rotor 6. The portion of the periphery of the refining surface 5' of the stator 5 that faces the protruding part 30 has no blade bars, blade grooves or refining grits arranged thereto, said portion forming a substantially smooth counter surface 31 to the protruding part 30 in the rotor 6. The protruding part 30 is dimensioned to extend in the height direction of the blades in the refining surface 6' above the blade bars and the blade grooves in the refining surface 6' and the refining grits 25 placed to the top surface of the blade bars to the extent that the blade bars and/or the blade grits on the refining surfaces 5', 6' of the stator 5 and the rotor 6 cannot touch each other in the event of a contact between the stator 5 and the rotor 6. FIG. 16 is a schematic cross-sectional view of the disc refiner of FIG. 15 at the protruding part 30, seen from the direction of the periphery of the disc refiner 1.

Figure 17:
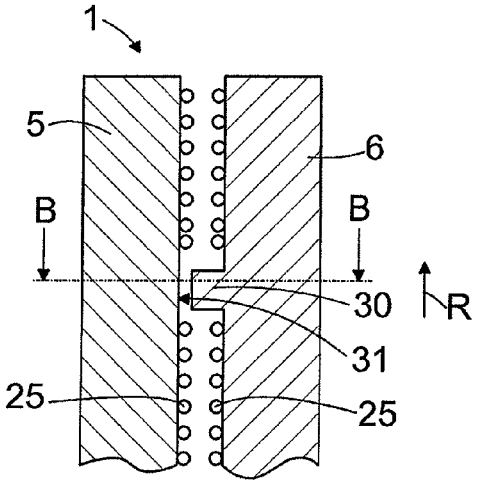
FIG. 17 is a schematic side view of a fourth disc refiner in cross-section.
Figure 18:
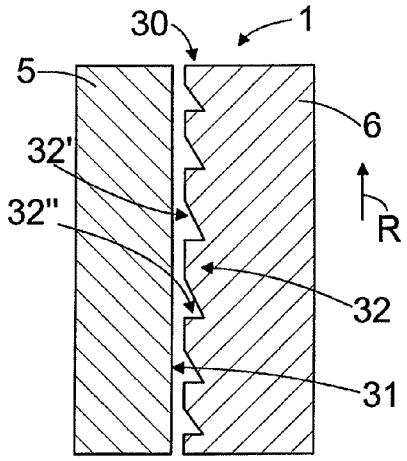
FIG. 18 is a schematic view of a detail of the disc refiner of FIG. 17 in cross-section.

FIG. 17 is a schematic side view of a fourth disc refiner 1 in cross-section, in which the protruding part 30 provided in the rotor 6 and the counter surface 31 provided in the stator 5 are placed on the center part of the refining surfaces 5', 6'. FIG. 18 is a schematic cross-sectional view of the disc refiner of FIG. 17 at the protruding part 30, seen from the direction of the periphery of the disc refiner 1. FIG. 18 brings into view bevel portions 32 formed to the protruding part 30, the portions comprising a section 32' inclined in relation to the plane of the refining surface 6' and a straight portion 32" substantially parallel to the normal of the plane of the refining surface 6' and facing the direction of rotation R of the rotor 6. The inclined portion 32' allows the material to be refined to move to the upper surface of the bevel portion 32 between the stator 5 and the rotor 6 so that the material to be refined may prevent contact between the stator 5 and the rotor 6. The straight portion 32" in turn forms a support surface of a sufficiently large surface area to keep surface pressure between the rotor and the stator so low that the rotor and the stator do not touch each other, or, if they do, the surfaces are not damaged. Moreover, the straight portion 32" enhances the moving of the material to be refined from the direction of the inner circumference of the refiner 1 toward the periphery thereof.

In the embodiments of FIGS. 15, 16, 17 and 18 the refiner 1 comprises a protruding part only on the rotor to prevent the refining surfaces from being damaged in case the stator and the rotor touch each other. Unlike in the embodiments of FIGS. 15, 16, 17 and 18, the protruding part may also be arranged to the stator only. Although in the embodiments of FIGS. 12, 15, 16, 17 and 18 the protruding parts 29, 30 form a single uniform structure with the corresponding refining elements, the protruding parts 29, 30 may also be made as separate parts to be fastened to the refining elements by a screw attachment, for example, in which case they are replaceable. The protruding parts 29, 30 may need to be replaced due to wear, for example. The features shown in FIGS. 15, 16, 17 and 18 may also be applied to cone and cylindrical refiners.

Figure 19:
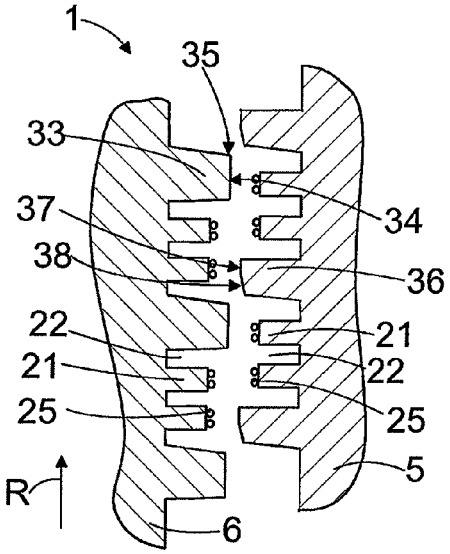
FIG. 19 is a schematic side view of a fifth disc refiner in cross-section.

FIG. 19 is a schematic side view of a fifth disc refiner 1 in cross-section. The disc refiner 1 has a stator 5 and a rotor 6. The refining surface of the stator 5 is provided with blade bars 21 and blade grooves 22, and the top surface of the blade bars 21 with refining grits 25. The top surface of the blade bars of the stator 5 could also be provided with second blade bars 23 and second blade grooves 24. The refining surface of the stator 6 is provided with blade bars 21 and blade grooves 22, and the top surface of the blade bars 21 with refining grits 25. The top surface of the blade bars of the rotor 6 could also be provided with second blade bars 23 and second blade grooves 24. Further, the refining surface of the rotor 6 in the refiner 1 of FIG. 19 has support bars 33 positioned between the blade bars 21 to extend away from the refining surface of the rotor toward the stator 5 and dimensioned to extend above the blade bars 21 of the refining surface of the rotor 6 and the refining grits 25 on the top surface thereof. The support bar 33 has a top surface 34 toward the stator and an edge 35 directed toward the direction of rotation R of the rotor 6. Further, the refining surface of the stator 5 in the refiner 1 of FIG. 19 has support bars 36 positioned between the blade bars 21 to extend away from the refining surface of the stator 5 toward the rotor 6 and dimensioned to extend above the blade bars 21 of the refining surface of the stator 5 and the refining grits 25 on the top surface thereof. The support bar 36 has a top surface 37 directed toward the rotor 6 and provided with a bevel 38 that is arranged to rise toward the top surface of the support bar 36 in the direction of rotation R of the rotor 6, i.e. the bevel 38 is arranged to become lower or smaller in a direction away from the support bar 33 provided in the rotor 6. As the rotor 6 rotates in relation to the stator 5, the movement between them causes material to be refined and vapor that is generated during the refining to be pressed at the bevel 38 between the top surfaces 34, 37 of the support bars 33, 36, thus causing an uplift force between the stator 5 and the rotor 6 to push the stator 5 and the rotor 6 away from one another.

Appropriate design and dimensioning of the shape and size of the bevels 38 and their position in the direction of the support bars 36 allows a situation to be created in which there is always a force acting between the stator 5 and the rotor 6 that pushes them away from one another. Consequently, the refining surfaces never tend to touch each other but to move away from one another, the distance between them being easy to adjust in a reliable manner by only adjusting the support force of the device pressing the refining surfaces together from the outside. The support bars 33, 36 may extend in a direction from the supply edge of the refining surface toward the discharge edge, either on the entire refining surface area or only on a restricted portion of the refining surface.

The support bars 33, 36 thus also form protruding parts of a kind to prevent the refining surfaces from touching one another. In addition, the support bars 33, 36 may participate in the refining of the fibrous material by an edge 35 provided in the support bar 33, which may act as a cutter cutting the fibers, and the fibrous material caught between the top surfaces 34, 37 of the support bars 33, 36 may be rubbed and ground smaller between the surfaces.

Figure 20:
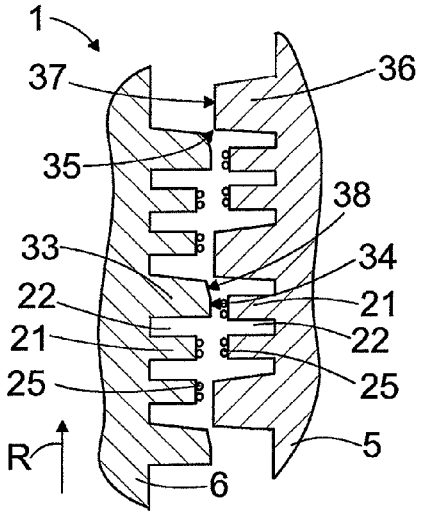
FIG. 20 is a schematic side view of a sixth disc refiner in cross-section.

FIG. 20 is a schematic side view of a sixth disc refiner 1 in cross-section. The rotor 6 in the refiner 1 of FIG. 20 has a support bar 33 that comprises a bevel 38 which is arranged to rise toward the top surface 34 of the support bar 33 in a direction that is opposite to the direction of rotation R of the rotor 6. The support bar 36 in the stator 5, in turn, comprises an edge 35 which is also arranged to a direction opposite to the direction of rotation R of the rotor 6. The operation of the refiner 1 of FIG. 20 corresponds to that disclosed with reference to FIG. 19.

Figure 21:
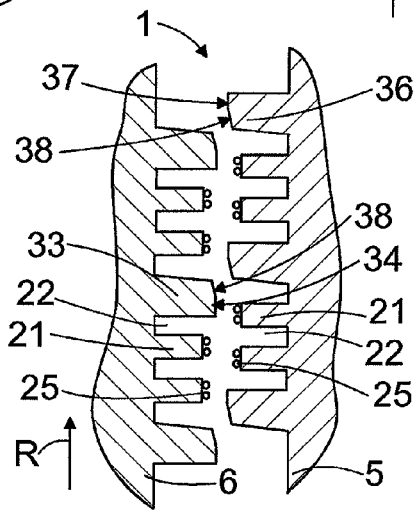
FIG. 21 is a schematic side view of a seventh disc refiner in cross-section.

FIG. 21 is a schematic side view of a seventh disc refiner 1 in cross-section. Both the support bar 33 in the rotor 6 and the support bar 36 in the stator 5 of the refiner 1 in FIG. 20 comprise a similar bevel 38 as the one shown in FIGS. 19 and 20. The operation of the refiner 1 of FIG. 21 corresponds to that disclosed with reference to FIGS. 19 and 20. In the refiner of FIG. 21, in which both the support bars 33 in the rotor and the support bars 36 in the stator are provided with a bevel 38, a greater force pushing the stator and the rotor away from one another may be achieved than when only the support bars of either the stator 5 or the rotor 6 is provided with a bevel.

The support bars 33, 36 of FIGS. 19, 20 and 21 may naturally be used also in cone and cylindrical refiners.

FIGS. 5 to 8 only show some possible embodiments of the first blade bars 21, first blade grooves 22, second blade bars 23 and/or second blade grooves 24, and the implementation of the blade bars 21, 23 and the blade grooves 22, 24 may differ from the embodiments just disclosed in the figures.

The blade elements according to the solution may be used both in high-consistency (HC) refiners and in low-consistency (LC) refiners. In high-consistency refiners the consistency of the material to be refined is typically over 25% or over 30%, whereas in low-consistency refiners the consistency of the material to be refined is typically less than 8% and often less than 5%.

It will be apparent to a person skilled in the art that as technology advances, the basic idea of the invention may be implemented in many different ways. The invention and its embodiments are thus not restricted to the examples described above but may vary within the scope of the claims.

We claim:

1. A blade element arrangement for a refiner for refining fibrous material, the blade element arrangement comprising:

a plurality of blade elements comprising a first blade element and a second blade element;

wherein the first blade element comprises a first blade body having portions extending therefrom which define a plurality of first blade bars and first blade grooves therebetween, the first blade bars having top surfaces defining a refining surface;

wherein the first blade bar top surfaces are provided with refining grits attached thereto so as to form a part of said first blade bars;

wherein the first blade element has portions forming a protruding part extending away from the refining surface and dimensioned to extend above the first blade bar top surfaces and the refining grits attached thereto; and wherein the protruding part extends outwardly of the refining surface so as to contact the second blade element, wherein the second element has an opposed refining surface, so that in a refiner the protruding part prevents the refining grits of the first blade bars from contacting said opposed refining surface.

2. The blade element arrangement of claim 1 wherein the protruding part has portions forming a top surface and portions forming a beveled surface sloping upwardly away from the refining surface to join the top surface.

3. The blade element arragmenet of claim 1 wherein the first blade bars have portions which form second blade grooves dividing the top surfaces of the first blade bars into second blade bars with the second grooves therebetween, the second blade bars forming the top surfaces of the first blade bars, and the second blade grooves interconnecting the first blade grooves across the first blade bars; and wherein the top surfaces of the second blade bars are provided with the refining grits.

4. The blade element arrangement of claim 1 wherein at least some of the refining grits on the top surfaces of the first blade bars are arranged in an irregular pattern.

5. The blade element arrangement of claim 1 wherein at least some of the refining grits on the top surfaces of the first blade bars are arranged in a regular pattern.

6. The blade element arrangement of claim 5 wherein the refining grits are composed of individual refining grits that are arranged on the top surface of the first blade bars of the first blade element so that the top surface of the first blade bars has refining grit lines or rows, spaced from one another, the individual refining grits in each refining grit line or row being positioned one after the other.

7. The blade element arrangement of claim 1 wherein at least some of the refining grits have a regular shape.

8. The blade element arrangement of claim 7 wherein the refining grits are in a form of a polygon.

9. The blade element arrangement of claim 1 wherein the refining grits are of a material selected from the group consisting of aluminum oxide, industrial diamond, tungsten carbide, silicon carbide, zirconium(IV)oxide, cubic boron nitride and hard metal.

10. The blade element arrangement of claim 1 wherein the first blade element is placeable side by side with at least one additional blade element so that the first blade element and the at least one additional blade element placed next to one another are arranged to form an entire refining surface as used in a refiner.

11. A refiner for refining fibrous material, the refiner comprising:

two opposed refining elements positioned opposed at a distance to one another and at least one of said two opposed refining elements mounted for motion in relation to the other;

wherein the two opposed refining elements define opposing refining surfaces for refining fibrous material, one of the opposing refining surfaces being on each of the two opposed refining elements;

wherein one of the two opposed refining elements has portions forming blade bars and blade grooves therebetween, the blade bars and blade grooves therebetween defining one of the opposing refining surfaces for refining fibrous material;

wherein portions of one of the two opposed refining elements has a refining surface that is provided with refining grits;

wherein one of the two opposed refining elements has portions forming a protruding part extending toward the other of the two opposed refining elements, the protruding part dimensioned to extend above the blade bars or the refining grits; and wherein the protruding part is arranged to prevent the blade bars or the refining grits on the opposed refining elements from touching one another.

12. The refiner of claim 11 wherein the protruding part has portions forming a top surface and portions forming a beveled surface sloping upwardly to join said top surface that is arranged to guide the fibrous material to be refined and vapor generated during the refining between the at least two opposed refining elements so as to create a force between the at least two opposed refining elements that pushes the at least two opposed refining elements away from each other.

13. The refiner of claim 11 further comprising a frame, and wherein the two opposed refining elements comprise one first fixed refining element mounted fixedly to the frame and one second movable refining element mounted for movement to the frame;

wherein the one first fixed refining element has a refining surface without blade bars or blade grooves, and with the refining grits attached thereto; and wherein the one second movable refining element is one of the two opposed refining elements having portions forming blade bars and blade grooves therebetween.

14. The refiner of claim 13 wherein the refining surface of the second movable refining element has refining grits attached to a top surface of at least one blade bar.

15. The refiner of claim 11 wherein one of the two opposed refining elements has one blade element arranged to form a part of the refining surface of the one of the two opposed refining elements.

16. The refiner of claim 15 wherein at least one of the two opposed refining elements comprises a plurality of blade elements arranged to form one of the opposing refining surfaces.

17. The refiner of claim 11 wherein the refining surfaces of the two opposed refining elements each have refining grits attached thereto and wherein the refining grits are arranged attached side by side to the refining surfaces;

wherein each refining surface defines a plane;

wherein each refining surface defines a refining surface periphery;

wherein said two opposed refining elements are mounted for motion in relation to the other to define a direction of movement of the refining elements in relation to one another;

wherein the refining grits on each refining surface are arranged to form at least one track parallel to the periphery of the refining surface; and wherein the tracks on one of the refining surfaces of the two opposed refining elements are arranged spaced from the tracks on the other of the refining surfaces in a direction that is parallel to the plane of the refining surface and substantially transverse to the direction of movement of the refining elements in relation to one another.

18. The refiner of claim 11 wherein the refiner is a disc refiner, a cone refiner or a cylindrical refiner.

19. A blade element forming part of a refining surface of one of a stator and a rotor, in a refiner for refining fibrous material, the refiner defining an axial direction about which the rotor is mounted to rotate in the refiner, the blade element comprising:

wherein the blade element has a bottom surface and portions of the blade element opposite the bottom surface defining a plurality of blade bars and blade grooves therebetween, the blade bars extending in the axial direction away from the bottom surface and having top surfaces which form part of a refining surface which extends across the top surfaces and the blade grooves therebetween;

wherein at least one blade bar of the plurality of blade bars has a top surface with refining grits attached thereto so as to form a part of the blade bar;

wherein the blade element has portions extending in the direction away from the bottom surface of the blade element to define a protruding part which extends above all of the plurality of blade bars; and wherein the protruding part extends outwardly of the refining surface so as to contact an opposed surface in a refiner and prevent the refining grits of the least one blade bar from contacting said opposed surface.

* * * * *